US005551339A

United States Patent [19]

Schädlich et al.

[11] Patent Number: 5,551,339

[45] Date of Patent: Sep. 3, 1996

[54] PROCESS AND DEVICE FOR REGISTER-CORRECT POSITIONING OF PRINTING FORM SLEEVES

[75] Inventors: Ralf Schädlich; Klaus Reichenbach; Klaus Koblitz; Udo Meier, all of Plauen, Germany

[73] Assignee: Man Roland Druckmaschinen AG, Offenbach am Main, Germany

[21] Appl. No.: 373,976

[22] Filed: Jan. 18, 1995

[30] Foreign Application Priority Data

Jan. 18, 1994 [DE] Germany ..... 44 01 269.1

[51] Int. Cl.[6] ..... B41F 27/00

[52] U.S. Cl. ..... 101/216; 101/248; 101/375; 101/486; 101/DIG. 36; 33/621; 492/9

[58] Field of Search ..... 101/216, 217, 101/248, 181, 183, 375, 376, 389.1, 481, 483, 485, 486, DIG. 36; 33/614, 615, 617–621; 492/9–11, 18

[56] References Cited

U.S. PATENT DOCUMENTS

| | | | |
|---|---|---|---|
| 5,092,242 | 3/1992 | Knauer | 101/248 |
| 5,216,954 | 6/1993 | Thompson | 101/375 |
| 5,379,693 | 1/1995 | Hoffmann et al. | 101/375 |

FOREIGN PATENT DOCUMENTS

| | | | |
|---|---|---|---|
| 236741 | 9/1987 | European Pat. Off. | 101/389.1 |
| 2542748 | 4/1976 | Germany . | |
| 3015159 | 11/1980 | Germany . | |
| 3614578 | 11/1987 | Germany . | |
| 3633855 | 4/1988 | Germany . | |
| 4106062 | 6/1992 | Germany . | |
| 9211483 | 1/1993 | Germany . | |
| 4140768 | 6/1993 | Germany . | |
| 4208179 | 9/1993 | Germany . | |
| 4239089 | 11/1993 | Germany . | |
| 8802756 | 6/1990 | Netherlands | 101/DIG. 36 |
| 1581233 | 12/1980 | United Kingdom . | |

OTHER PUBLICATIONS

JP 4–345846 in Patent Abstracts of Japan, M–1399, Apr. 20, 1993, vol. 17, No. 201.

*Primary Examiner*—Stephen Funk
*Attorney, Agent, or Firm*—Cohen, Pontani, Lieberman, Pavane

[57] ABSTRACT

A process and a device for register-correct positioning of printing form sleeves on printing cylinders of a rotary printing machine, each with a pressure gas cushion producible for shifting the elastically expandable printing form sleeve on the printing form cylinder. In order to provide quick register-correct positioning of the printing form sleeves without placing particular demands on the operating personnel, the positions of the printing form sleeves fitting tightly onto the printing cylinders are determined and then the printing form sleeves are individually set and released using the pressure gas cushion of the particular printing cylinder. Then the printing cylinder is turned relative to the printing form sleeve by its angular deviation relative to the register-correct position to be realized. Subsequently the printing form sleeve is again released as well as set relative to the printing cylinder by turning off of the pressure gas cushion.

19 Claims, 2 Drawing Sheets

PROCESS AND DEVICE FOR REGISTER-CORRECT POSITIONING OF PRINTING FORM SLEEVES

BACKGROUND OF THE INVENTION

1. Field of the Invention

The invention relates to a process and a device for register-correct positioning of printing form sleeves on printing cylinders of rotary printing machines.

2. Description of the Related Art

A method is known from DE 41 40 768 A1 of producing, with the help of form-fitting or optical register devices such as register pins of the printing form cylinder which grip into recesses of the printing form sleeve in a register-correct manner or markings on the printing form sleeve and printing form cylinder which are to be brought into agreement, correct register positioning of the printing form sleeve releasably making possible shifting relative to the printing cylinder through a pressure gas pad.

Such a register-correct alignment of multiple printing form sleeves during their respective placement onto the printing cylinder s relatively complicated and requires the use of meticulous care by operating personnel.

SUMMARY OF THE INVENTION

The invention is based on the object of creating a process and a device for the register-correct positioning of printing form sleeves, which process and device provide, without placing particular demands on the operating personnel, quick register-correct positioning, particularly of multiple printing form sleeves placed on various printing cylinders.

Pursuant to this object, and others which will become apparent hereafter, one aspect of the present invention resides in determining positions of the printing form sleeves which are fitted tightly by friction on the printing cylinders, individually setting and releasing the respective printing form sleeves to and from the respective printing cylinder with a pressure gas cushion, then turning the respective printing cylinder relative to the printing form sleeve by an angular deviation relative to a register-correct position to be realized. Subsequently, the printing form sleeve is released once again and set relative to the printing cylinder by turning off the pressure gas cushion.

Another aspect of the present invention resides in a device for register-correct positioning of the printing form sleeves on the printing cylinders of a rotary printing machine. This device includes measuring means for measuring the angular deviations of the printing form sleeves relative to their register-correct positions. Drive means are provided for rotating the printing cylinders by the angular deviations. Furthermore, holding means are provided for holding the printing form sleeve when released by the pressure gas cushion during rotation of the printing cylinder.

Because the printing form sleeve can be placed onto the printing cylinder in any desired position without any obligation on the part of the operating personnel to work meticulously in respect to register-correctness, the inventive process is realizable in a short period of time.

The subsequent automatic setting, free from human influence, of the register-correct positions of the printing form sleeves permits exact register-correctness in a short time even taking into account influence factors of the printing process. For example, only two drive rotations are needed for the measurement run to determine the position of the slipped-on printing form sleeves and their subsequent register-correct positioning.

A further embodiment of the inventive process includes aligning the printing form sleeves laterally on the printing cylinders before a measurement run of the drive means. The after-running of the drive means can be determined during a measurement run and be used to determine a correction value for the angular deviations. After-running refers to the rotation of the printing cylinder that occurs after the drive is shut off. It is also possible to respectively calculate the various web lengths between the printing cylinders for different production variations as a correction value for the particular angular deviation. In a further embodiment, processing characteristic variables which influence the web length between the printing cylinders are calculated as a correction value for the particular angular deviation.

In still a further embodiment, the printing cylinders are braked during the measurement run and the positioning sequence in a manner which prevents drive play. The measurement run and positioning sequence are preferably undertaken at a drive speed of approximately 1 rpm. of the drive unit.

Furthermore, register devices for production runs can be moved to the center of their adjustment range before equipping the printing cylinders with the printing form sleeves. Deviations of the registered devices from the center of their adjustment range are detected during the equipping of the printing cylinder with the printing form sleeves and these detected deviations are considered during the correction of the angular deviations.

In another embodiment of the inventive device, sensor means recognize a position marking on the printing sleeves. An incremental transducer is connected to the drive means of the printing cylinders and the incremental transducer as well as the sensor means are connected to a computer that determines the angular deviation of the printing form sleeves relative to the register-correct positions. Control means are connected to the drive means and the computer for controlling a correction of the particular angular deviation. The holding means is operatively connected to the computer for causing fixing of the particular associated printing form sleeves during the correction procedure. The computer is further connected or connectable to an arrangement for producing the pressure gas cushion so as to control this arrangement.

The computer can be provided with correction values as input variables that take into account web length changes between the printing cylinders resulting from different production variations and processing characteristic variables. In still another embodiment of the invention, the holding means includes at least one extractor for each printing form sleeve which is adapted to be placeable on the respective printing form sleeve.

Yet another embodiment of the invention provides a lateral register stop arranged on the printing cylinders for stopping the printing form sleeves. The register stop can be adapted to be displacement-controllable and pneumatically moveable from the respective printing cylinder.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
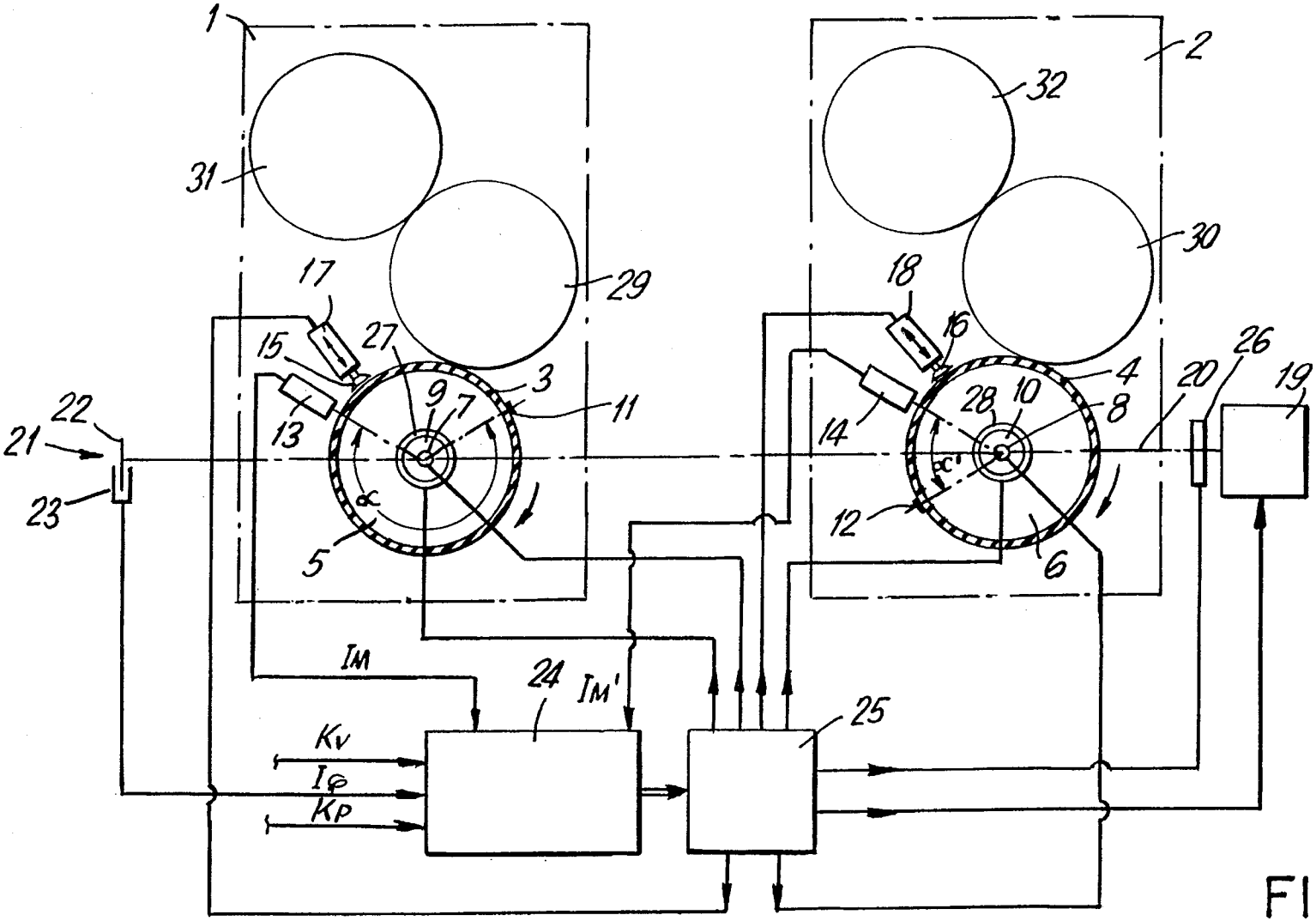
FIG. 1 schematically illustrates a device for the register-correct positioning of multiple printing form sleeves on the printing cylinders of various printing units of a rotary printing machine, pursuant to the present invention.

As shown in FIG. 1, two printing groups 1, 2, conceivably both for direct and indirect printing, are equipped respectively with a printing cylinder 5, 6 that carries a printing form sleeve 3, 4.

The elastically expandable printing form sleeves 3, 4 are slipped frontally onto the printing cylinders 5, 6 by means of a pressure gas cushion which can be provided on the circumference of the cylinders. The sleeves are held by friction on the printing cylinder after reaching a register stop which can be moved out on the opposite side, preferably pneumatically, from the respective printing cylinders 5, 6.

The pressure gas is, in each case, supplied through known supply devices, not shown, including among other items, directional valves, and is introduced into the printing cylinder 5, 6 through an axial bore 7, 8 of the journal 9, 10. The gas then exits via circumferential openings in the cylinder 5, 6.

Each of the printing form sleeves 3, 4 has a position marking 11, 12 executed, for example, as an optically-registerable register mark, which is recognizable by a frame-fixed sensor 13, 14.

In the area of the slipped-on printing form sleeve 3, 4, there is also a pneumatic holding device 17, 18 equipped with an extractor 15, 16 that can be placed on the printing form sleeve 3, 4.

The holding devices 17, 18, as well as the sensors 13, 14, can be attached to the frame of the printing machine so as to be adjustable or able to be swung away for better accessibility during the change of printing form sleeves 3, 4.

The printing cylinders 5, 6 are driven by a drive 19 via a common drive shaft 20, to which an incremental transducer 21 is connected. The transducer 21 consists of a dividing plate 22 provided with optical markings and resting on the drive shaft 20, and an opto-electrical sensor 23 fixed to the frame of the priming machine.

The pulse I of the incremental transducer 21 as well as the pulse IM, IM' of the sensors 13, 14 caused by the position markings 11, 12 of the priming form sleeves 3, 4 are sent to a computer 24. The computer 24 is connected to a control unit 25 that controls the drive 19, places the holding devices 17, 18 into operation and causes the activation of a brake 26, 27, 28 resting, respectively, on the journals 9, 10 of the priming cylinder and connected to the drive 19.

After equipping the priming cylinder 5, 6 with the printing form sleeves 3, 4, there occurs through the drive 19 a measurement run of one rotation at creep speed, in order to determine the positions of the printing form sleeves 3, 4 which have been slipped-on in any random or desired position. From the pulses IM, IM' of the sensors 13, 14 and the pulses Iϕ of the incremental transducer 21, the computer calculates the particular angular deviation α, α' of the printing form sleeves 3, 4. In a subsequent second drive rotation, the deviations are corrected in sequence beginning with the smallest angular deviation α' and ending with increasing size at the largest angular deviation α, in that, respectively, the extractor 16 or 15 of the holding devices 18 or 17 is set in a fixing manner on the printing form sleeve 4 or 3. The printing form sleeve is released through the production of the pressure gas cushion by the printing cylinder 6 or 5, which thereupon is rotated by the angle deviation α' or α. After the pressure gas cushion is turned off, the printing form sleeve 4 or 3 sets itself in the register-correct position on the printing cylinder 6 or 5 and is released again by the holding device 18 or 17.

In order to avoid drive play, the brakes 26, 27, 28 are applied both during the measurement run and during adjustment of the register, i.e., with reduced braking force.

Because the web lengths between the printing groups 1, 2 change in dependence on the production variants, corrections KP are entered into the computer that take this into account.

The same also applies for processing variables influencing the web lengths, such as, for example, stretching or shrinking of the continuous web and separation behavior of the transfer cylinders. These are also entered into the computer as correction values KV. These correction values KP, KV, as well as the after-running of the drive also determined during the measurement run, are also calculated by the computer 24 into the particular angular deviation α,α' to be corrected.

Depending on whether, in the case of the printing groups 1, 2, indirect or direct printing is being carried out, the middle cylinder 29, 30 working together with the printing cylinder 5, 6 functioning as a form cylinder may be a transfer cylinder or a counter-pressure cylinder, and the following outer cylinder 31, 32 may be a counter-pressure cylinder or an additional form cylinder.

Figure 2:
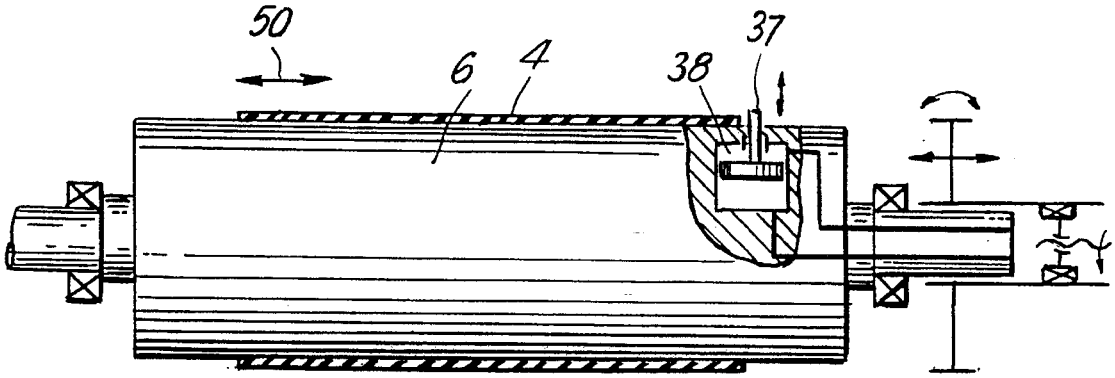
FIG. 2 is a side view of the printing cylinder showing a lateral register stop.

As seen in FIG. 2, a printing form sleeve 4 is slidable onto and off of the printing cylinder 6, as indicated by the arrow 50. A register stop 37 is constructed as a register pin that can be extended from the jacket surface of the printing cylinder 6 by a pneumatic working cylinder 38. The printing form sleeve 4 is slid onto the printing cylinder 6 until the sleeve 4 contacts the pin 37. At this point the sleeve is in proper lateral register. Next, the pin 37 is pulled back into the body of the printing cylinder 6 by the working cylinder 38. Air pressure for the working cylinder 38 is provided via lines that run through the cylinder journal 33.

In order to ensure that the adjustment range of the register devices for production run, such as adjustment gears remains adequate after the register-correct positioning of the printing form sleeves 3, 4 on the printing cylinder 5, 6, it is useful to set these register devices to the middle of their adjustment range before equipping the printing cylinder 5, 6 with the printing form sleeves 3, 4, to determine their positions deviating from the center of their adjustment range during the equipping of the printing cylinders 5, 6 with the printing form sleeves 3, 4, and accordingly during the correction to additionally take into consideration all angle deviations α, α', to which end, particularly in the latter case, the information necessary for this must be supplied to the computer.

The invention is not limited by the embodiments described above which are presented as examples only but can be modified in various ways within the scope of protection defined by the appended patent claims.

We claim:

1. A process for register-correct positioning of at least one elastically expandable printing form sleeve on at least one printing cylinder of a rotary printing machine with, in each case, a pressure gas cushion producible on respective ones of the printing cylinders for shifting the elastically expandable printing form sleeve, the method comprising the steps of: determining positions of the priming form sleeves fitting tightly through friction sealing on the printing cylinders; individually setting and releasing the respective priming form sleeves to and from the respective printing cylinder using the pressure gas cushion; holding the priming form sleeve; turning the respective printing cylinder relative to the priming form sleeve by an angular deviation to obtain a register-correct position to be realized; and subsequently letting go of the priming form sleeve and setting the priming form sleeve onto the printing cylinder by turning off the pressure gas cushion.

2. A process as defined in claim 1, including driving the printing cylinders through a measurement run with a drive, the position determining step including recognizing position markings on the printing form sleeves using sensors, and sending pulses from the sensors to a computer, the computer determining the angular deviations of the printing form sleeves relative to their register-correct position on the basis of the signals from the sensors as well as pulses received from an incremental transducer connected to the drive, the method further including controlling the drive of the printing cylinders and holding devices for holding the printing form sleeves with a control unit, and controlling the pressure gas cushion with the control unit so that the printing form sleeves can be held and released by the holding devices and so that the pressure gas cushion can be turned on and off, the turning step including rotating the printing cylinder by the angular deviation and then subsequently setting the printing form sleeve in the register-correct position on the printing cylinder by turning off the pressure gas cushion and releasing the printing form sleeve from the holding device.

3. A process as defined in claim 2, including aligning the printing form sleeves laterally on the printing cylinders before the measurement run of the drive.

4. A process as defined in claim 2, including positioning the printing form sleeves register-correctly beginning with a printing form sleeve having a smallest angular deviation and then positioning in an order of increasing angular deviation within one rotation of the drive.

5. A process as defined in claim 2, including determining after-running of the drive during the measurement run and calculating the after-running as a correction value for the angular deviations to be equalized.

6. A process as defined in claim 2, including respectively calculating various web lengths between the printing cylinders of production variations with the computer as a correction value for the particular angle deviation to be equalized.

7. A process as defined in claim 2, including respectively calculating processing characteristic variables which influence web lengths between the printing cylinders as a correction value for the particular angle deviation to be equalized, using the computer.

8. A process as defined in claim 2, including braking the printing cylinders during the measurement run and during positioning, to prevent drive play.

9. A process as defined in claim 2, including carrying out the measurement run and positioning sequence at a drive creep speed of 1 rpm.

10. A process as defined in claim 1, including moving register devices for production runs to a center of their adjustment range before the printing cylinders are equipped with the printing form sleeves.

11. A process as defined in claim 10, including detecting deviations of the register devices for production runs from the center of their adjustment range during equipping of the printing cylinder with the printing form sleeves, and taking the detected deviations into consideration during correction of all angular deviations.

12. A device for register-correct positioning of elastically expandable printing form sleeves on printing cylinders of a rotary printing machine having an arrangement for producing a pressure gas cushion that permits shifting of the elastically expandable printing form sleeves which are respectively provided with a position marking, the device comprising: measurement means for measuring angular deviations of the printing form sleeves relative to register-correct positions; drive means for rotating the printing cylinders by the angular deviations; and holding means for holding a respective printing form sleeve when released by the pressure gas cushion during rotation of a respective printing cylinder.

13. A device as defined in claim 12, and further comprising sensor means for recognizing the position marking, an incremental transducer connected to the drive means of the printing cylinders, computer means operatively connected to the incremental transducer and the sensor means for determining the angular deviation of the printing form sleeves relative to the register-correct positions, and control means connected to the drive means and the computer means for controlling a correction of the particular angle deviation, the holding means being operatively connected to the computer means for causing fixing of an associated printing form sleeve during the correction, the computer means being further operatively connectable to the arrangement for producing the pressure gas cushion whereby the pressure gas cushion can be controlled.

14. A device as defined in claim 13, and further comprising brake means respectively arranged separately on the printing cylinders and the drive means, the control means being operatively connected to the brake means.

15. A device as defined in claim 13, wherein the computer means is configured to take into account web length changes between the printing cylinders resulting from different production variations and processing characteristic variables.

16. A device as defined in claim 13, wherein the drive means includes a drive shaft, and the incremental transducer includes a dividing plate provided with optical markings and attached to the drive shaft, and further comprising an optoelectrical sensor arranged and adapted to sense the optical markings on the dividing plate.

17. A device as defined in claim 12, wherein the holding means includes at least one extractor for each printing form sleeve which is adapted to be placeable against the respective printing form sleeve.

18. A device as defined in claim 12, and further comprising a lateral register stop arranged on the printing cylinders for the printing form sleeves.

19. A device as defined in claim 18, and further comprising means for moving the register stop out from the respective printing cylinders.

* * * * *